US007037017B2

(12) United States Patent
Buck et al.

(10) Patent No.: US 7,037,017 B2
(45) Date of Patent: May 2, 2006

(54) WRITING IMPLEMENT WITH PAGE-TURNING ELEMENT

(75) Inventors: Janice E. Buck, 84 Seton Rd., Irvine, CA (US) 92612; Peter V. N. Heller, San Clemente, CA (US)

(73) Assignee: Janice E. Buck, Irvine, CA (US)

( * ) Notice: Subject to any disclaimer, the term of this patent is extended or adjusted under 35 U.S.C. 154(b) by 0 days.

(21) Appl. No.: 10/930,053

(22) Filed: Aug. 30, 2004

(65) Prior Publication Data

US 2005/0079003 A1 Apr. 14, 2005

Related U.S. Application Data

(63) Continuation-in-part of application No. 10/602,440, filed on Jun. 24, 2003, now abandoned.

(51) Int. Cl.
*B43K 29/00* (2006.01)

(52) U.S. Cl. ..... 401/195; 401/52

(58) Field of Classification Search ..... 401/6, 401/52, 195; 281/45; 15/3.53, 424–430; D19/53, 54, 58, 81, 99, 100
See application file for complete search history.

(56) References Cited

U.S. PATENT DOCUMENTS

| | | | | |
|---|---|---|---|---|
| 667,950 | A | | 2/1901 | Oelke |
| 1,736,430 | A | | 11/1929 | Dell |
| 2,419,746 | A | | 4/1947 | Veria |
| 3,133,526 | A | | 5/1964 | Sears |
| 3,615,596 | A | * | 10/1971 | Petti et al. ..... 426/104 |
| 3,813,176 | A | | 5/1974 | Kamo |
| 5,149,046 | A | | 9/1992 | Kerley et al. |
| D367,674 | S | * | 3/1996 | Kitzmiller ..... D19/53 |
| 5,735,544 | A | | 4/1998 | Buckner |
| 5,772,268 | A | | 6/1998 | Chabrier |
| 6,200,046 | B1 | | 3/2001 | Rylander |

FOREIGN PATENT DOCUMENTS

DE 295 02 759 U1 2/1995

* cited by examiner

*Primary Examiner*—Justine R. Yu
*Assistant Examiner*—Huyen Le
(74) *Attorney, Agent, or Firm*—Klein, O'Neill & Singh, LLP; Howard J. Klein

(57) ABSTRACT

A writing implement has a first end through which a writing tip extends and a second end to which is attached a page-turning element having a multiplicity of soft, deformable protuberances to enhance its frictional grip with paper sheets. In a first embodiment, the page-turning element is configured as a conformal cap covering the second end of the barrel. If the writing implement includes a writing tip extension and retraction mechanism operated by an actuation button in the second end of the barrel, the page turning-element overlies the button so that the button is actuated through the page-turning element by an external pressure applied thereto. A biasing element between the page-turning element and the second end of the barrel assures that the pressure needed for actuation of the button is greater than that which is normally applied through use of the page-turning element, thereby minimizing the possibility of inadvertent actuation.

28 Claims, 3 Drawing Sheets

WRITING IMPLEMENT WITH PAGE-TURNING ELEMENT

CROSS-REFERENCE TO RELATED APPLICATIONS

This application is a continuation-in-part of application Ser. No. 10/602,440, filed Jun. 24, 2003, now abandoned.

FEDERALLY SPONSORED RESEARCH OR DEVELOPMENT

Not Applicable

BACKGROUND OF THE INVENTION

This invention relates generally to the field of writing implements, such as pens and markers. More specifically, it relates to a writing implement with a page-turning element attached to the end opposite the writing tip.

Despite the proliferation of computers in the workplace, paper documents continue to be a major aspect of the modern office. Many office workers must deal with large numbers of paper documents, often comprising a large number of pages or sheets. Such workers frequently must search a lengthy paper file or stack of documents for a particular document or page, requiring them to flip through many pages before finding the sought-after document or page. Typically, workers have used their fingers to turn or flip through the pages in their searches. This leads to several problems. For example, workers frequently sustain paper cuts. Also, in order to provide better grip between one's fingers and the sheets of paper, the fingers are often moistened, typically with saliva or with a moistening pad. The use of moistening agents can lead to stained or smudged documents (particularly those marked with a water-soluble ink), and saliva also is unsanitary. Furthermore, the use of fingers is often awkward and slow, because the user often is searching a file for information to enter manually into another document, or for a space that must be filled in with a pen (e.g., a signature line), and the pen must be laid aside during the flipping and then picked up when it needs to be used.

There have been several approaches taken in the prior art to address the above-noted problems. Perhaps the most common approach has been the "rubber finger" or "finger guard," which comprises a rubber cap that fits over the end of a person's finger to provide enhanced friction between the finger and the paper. Such devices often have small bumps or protrusions on their exterior surface further to enhance friction. Such devices, however, do not address the difficulty of holding a writing implement while flipping through successive pages. Indeed, they may even increase the difficulty of writing due to the fact that device is installed on and covers the end of a finger. Furthermore, such finger guards need to be provided in different sizes to fit a variety of users, and they tend to cause and trap perspiration from the finger, which may impart an unpleasant odor to the device.

Another approach is to use an eraser attached to the writing implement to flip through paper sheets and pages. The eraser may be integral with the writing implement (as is the case with the typical pencil), or it may be a separate eraser that fits over the proximal end of a pencil. Erasers, however, are not well-suited for use as tools for flipping through paper files. Specifically, in erasing, they pick up ink, pencil graphite, and/or dirt that can soil or smear the pages with which they come into contact during the flipping procedure. Their inherently abrasive qualities can also contribute to smudging and smearing, and they wear down relatively quickly through normal use. Finally, the separate removable erasers are typically designed to fit on the end of a pencil, but they tend not to fit well on pens. In any case, they have a tendency to split after prolonged use. A variation on this concept is shown in U.S. Pat. No. 2,419,746—Veria, which discloses a removable eraser with a sponge rubber surface designed for use as a page-turning device. The sponge rubber surface, however, needs to be frequently moistened.

U.S. Pat. No. 5,735,544—Buckner discloses a page-turning device comprising a substantially spherical body with protuberances extending from its exterior surface, and a cylindrical bore configured for a removable friction fit over the proximal end of a writing implement. While this device overcomes many of the aforesaid problems with the rubber finger guard, it has other characteristics that may be disadvantageous. For example, the substantially spherical configuration gives the device an outside diameter that is considerably greater than that of the writing implement to which it is attached. This not only results in a costly waste of material that serves no purpose in the device, but also prevents the device from lying flat, thus creating possible problems with storage. In addition, the device must be removed to actuate the typical actuation button that operates the extension and retraction mechanism found in many pens. Furthermore, the cylindrical bore is sized to fit a "standard writing instrument," but modern writing implements assume such a wide variety of shapes and sizes that the concept of a "standard" writing instrument (other than the typical pencil) is elusive, if not altogether meaningless. In other words, a "one-size-fits-all" page-turning device is likely to have limited practical utility or market appeal.

Thus, there has been a long-sought, but as yet unmet need for a page-turning device that combines the high friction and non-abrading characteristics of a rubber finger guard with the convenience of being permanently attached to the end of a writing implement, and that does not need to be moistened. It would further be advantageous for such a page-turning device to have a diameter that does not substantially exceed that of the writing implement to which it is attached.

SUMMARY OF THE INVENTION

Broadly, the present invention is a writing implement comprising a barrel having main body extending between a first end through which a writing tip extends and a second end opposite the first end, and a substantially non-abradable elastomeric page-turning element attached to the second end, wherein the page-turning element has an exterior surface that is provided with a multiplicity of protuberances that are dimensioned for applying an optimum amount of shear force to a sheet of paper, thereby facilitating the use of the device to turn pages. The writing implement may be a pen or any other marking device that uses a liquid marking medium, such as a felt tip marker. Preferably, the page-turning element has maximum outside diameter that is not substantially greater than the maximum outside diameter of the second end of the barrel.

In a first specific embodiment, the page-turning element is configured as a conformal cap covering the second end of the barrel, and its exterior surface is advantageously formed with a multiplicity of integral soft, deformable protuberances or bumps to enhance its frictional grip with a sheet of paper. A writing tip extension and retraction mechanism may be contained within the barrel, the mechanism having an actuation button on the exterior of the main body of the barrel between the first and second ends. Alternatively, the actuation button can be located at the tip of the second end of the barrel, underneath the page-turning element.

A second embodiment is preferred for use with a writing implement having an actuation button extending axially from the second end of the barrel. In this second embodiment, a sleeve is slidably disposed over the second end of the barrel, a page-turning element is attached to the sleeve so as to overly the actuation button, and a biasing spring coaxially surrounds the actuation button and extends between the second end of the barrel and the interior of the page-turning element. The spring is selected so that its biasing force is sufficient to prevent the inadvertent depression of the actuation button when the page-turning element is used to turn pages, while still allowing the actuation button to be depressed without an excessive amount of force when it is desired to extend or retract the writing tip.

DETAILED DESCRIPTION OF THE INVENTION

Figure 1:
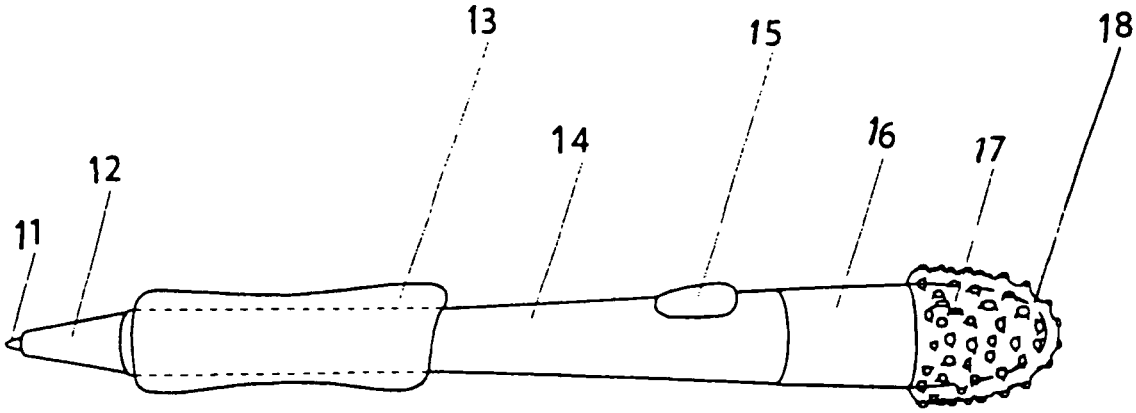
FIG. 1 is an elevational view of a writing implement with an integral page-turning element, in accordance with a first embodiment of the invention.
Figure 2:
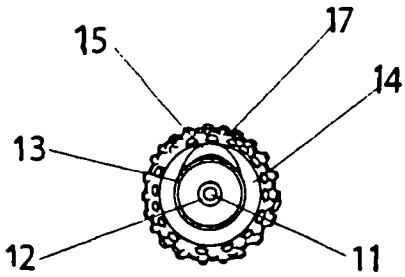
FIG. 2 is an end view of the writing implement of FIG. 1, viewed from the writing tip of the implement, i.e., the left side of FIG. 1.
Figure 3:
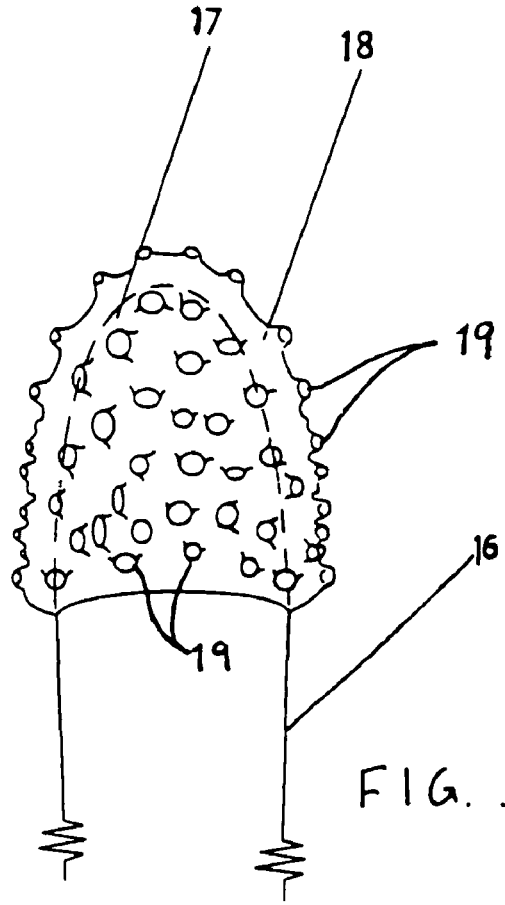
FIG. 3 is a detailed view of the second end of the barrel of the writing implement of the present invention, with the page-turning element attached.

Referring first to FIGS. 1–3, a writing implement 10, in accordance with a first embodiment of the invention, is shown. The writing implement 10 may be a pen or any other type of marker that uses liquid ink, such as, for example, a felt tip marker. For the purposes of the present discussion, however, the writing implement 10 will be referred to as a pen. The pen 10 includes a barrel 16 having a generally cylindrical main portion 14 extending between a tapered first end 12 and a second end 17 opposite the first end 12. The first end 12 has a central aperture through which a writing tip 11 extends. The writing tip 11, in the case of a pen, may be a ballpoint, a roller ball, a nib, or a felt tip. It communicates with an ink reservoir (not shown) contained within the barrel 16. The writing tip 11 may be fixed, or, preferably, it may be retractable by a conventional extension and retraction mechanism (not shown), of any type known in the art, that is contained within the barrel 16. In the preferred embodiment, the extension and retraction mechanism is operated by means of a button 15 on the exterior of the main portion 14 of the barrel 16. The main portion 14 of the barrel 16 may advantageously be fitted with a soft elastomeric grip 13 adjacent to the first end 12.

In this embodiment of the invention, the second end 17 of the barrel 16 is advantageously somewhat conical with a rounded apex or tip. Permanently fixed to the second end 17, by means such as a suitable adhesive, is an elastomeric page-turning element 18. The page-turning element 18 is preferably substantially conformal to the configuration of the second end 17, with a maximum outside diameter that is not substantially greater than the maximum outside diameter of the second end 17. For the purposes of this description, the term "not substantially greater than" should be read to mean not more than about 50% greater than, and preferably not more than about 25% greater than, the maximum outside diameter of the second end 17.

The page-turning element 18 is made of a moldable elastomeric material that is relatively soft and deformable, substantially non-abrasive, and substantially non-abradable. For the purpose of this description, the term "non-abradable" means that the material is not easily abraded or worn away by repeated frictional contact with paper. Thus the material does not cause significant abrasion of the paper, nor is it significantly abraded by the paper. The page-turning element 18 is formed with a textured, friction-enhancing exterior surface that provides a good frictional grip with a sheet of paper. Preferably, the friction-enhancing surface is provided by a multiplicity of deformable protuberances or bumps 19 that are integral with the page-turning element 18, as best shown in FIG. 3, but other types of textured surfaces, including micro-textured surfaces, may be used.

In a specific example of the present invention, the page-turning element 18 is preferably made of a relatively soft elastomeric material (such as a synthetic rubber) of approximately A Shore 40 or lower, to increase the effective area of the protuberance 19 that contact the sheets or pages to be turned, thereby increasing the degree of shear force transmitted to the sheets or pages, thus enhancing the page-turning ability of the device. Optimizing the length and spacing of the individual protuberances 19 can also contribute (along with proper selection of the protuberance material) to these advantageous effects. Specifically, it has been found to be advantageous to provide protuberances that are approximately 2–3 mm in length, with an average protuberance spacing of about 2–3 mm. These dimensions are understood to be exemplary only, and suitable results can be obtained with other protuberance lengths and spacings.

Figure 4:
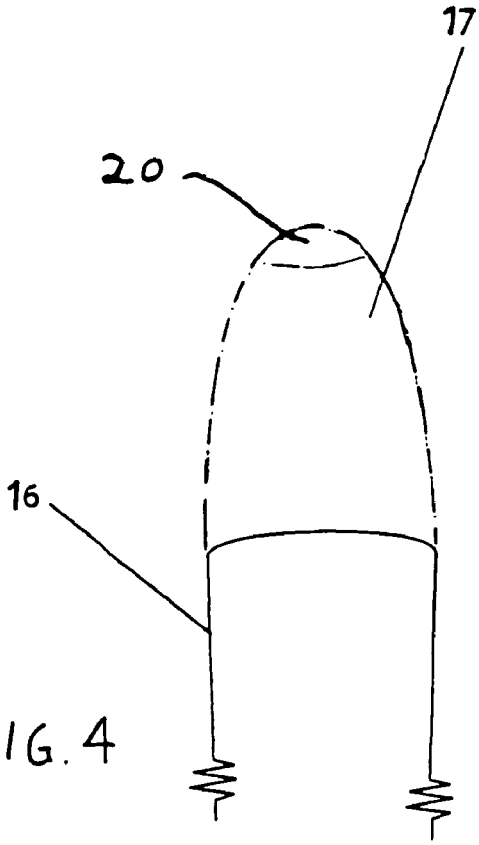
FIG. 4 is a detailed view of a second embodiment of the writing implement of the present invention, showing the second end of the barrel without the page-turning element.

FIG. 4 shows an alternative embodiment of the writing implement, in which an actuation button 20 for the actuation of the extension and retraction mechanism extends from the tip of the second end 17 of the barrel 16. In this embodiment, the page turning-element 18 fits over and covers the actuation button 20, and is sufficiently soft and compliant that the actuation button 20 can be actuated through the page turning element.

Figure 6:
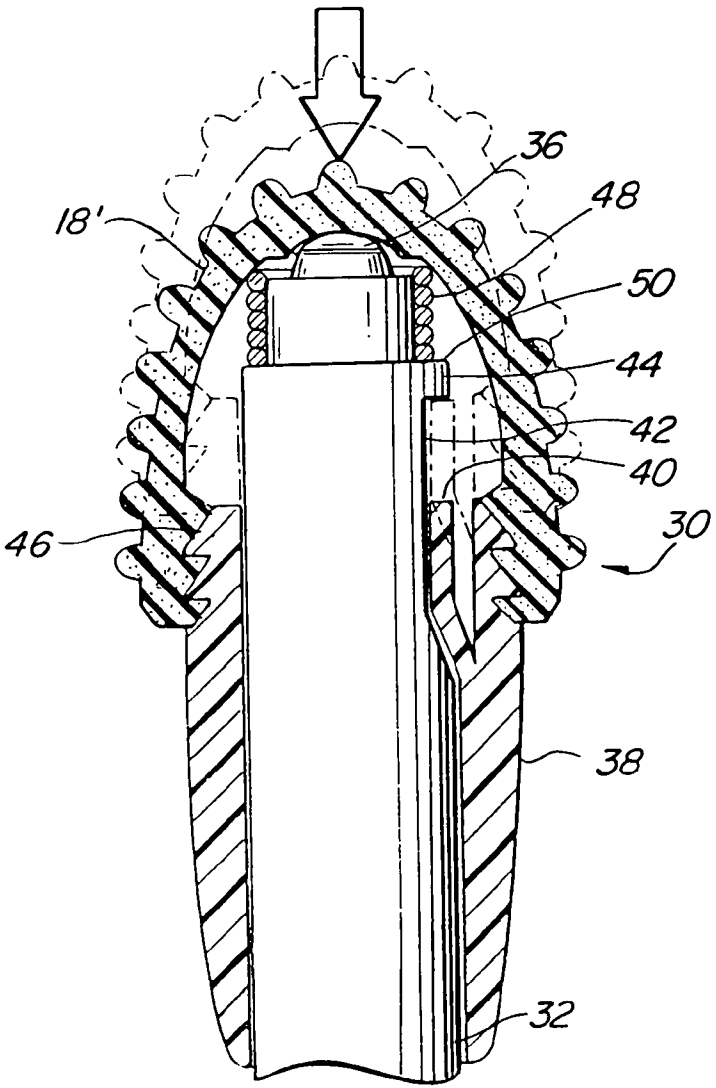
FIG. 6 is a view similar to that of FIG. 5, showing the page-turning element in a second position when the actuation button for the writing tip actuation mechanism is depressed.
Figure 5:
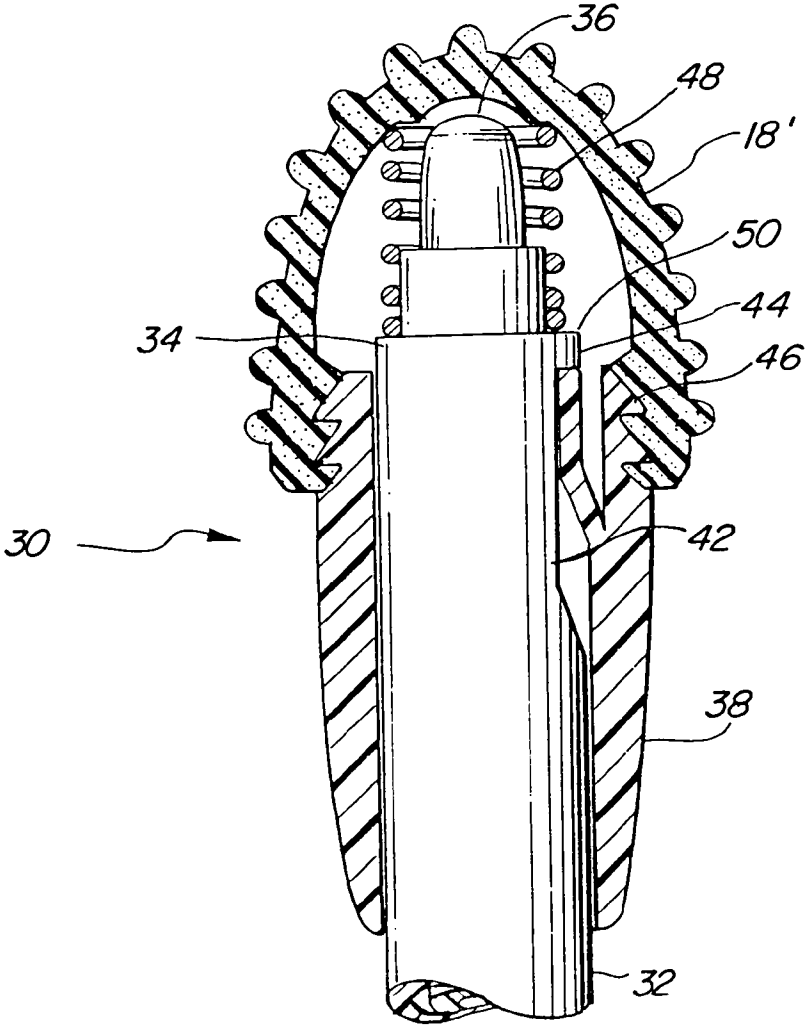
FIG. 5 is a detailed view, partially in cross-section, of a third embodiment of the present invention, showing the second end of the barrel of the writing implement with a spring-biased page-turning element attached to it, the page-turning element being in a first position corresponding to the retracted position of the writing tip.

FIGS. 5 and 6 illustrate a writing implement 30 in accordance with another embodiment of the invention. The writing implement 30 includes a barrel 32 having a first end 12 (see FIG. 1) and a second end 34. An actuation button 36 extends axially from the second end 34 of the barrel, and is used, as described above, for the actuation of the writing tip extension and retraction mechanism. A sleeve 38 is slidably mounted on the barrel 32 near the second end 34 of the barrel. The sleeve 38 advantageously has an interior finger 40 that rides in a longitudinal slot 42 in the second end 34 of the barrel 32, so as to inhibit or limit the rotation of the sleeve 38 around the axis of the barrel 32. The distal end of the slot 42 terminates in a slide stop or abutment 44 that defines a distal limit of travel for the finger 40 and therefore for the sleeve 38.

The sleeve 38 has a first (distal) end oriented toward the first end of the barrel, and a second (proximal) end oriented toward the second end of the barrel. Attached to the second end of the sleeve 38 is a page-turning element 18', which is similar to the page-turning element 18 described above. The page-turning element 18' may be mechanically attached to the sleeve 38 by means of mating circumferential ribs or ridges 46, as shown, or the two components may be attached by a simple friction fit or by an adhesive (not shown). When attached to the sleeve 38, the page-turning element 18' covers or overlies the actuation button 36.

A biasing member, such as a spring 48, preferably a coil spring as shown, is engaged between an annular shoulder 50 on the second end 34 of the barrel 32 and the interior surface of the page-turning element 18'. The spring 48 coaxially surrounds the actuation button 36, and it is selected to have a spring constant such that the biasing force applied distally against the page-turning element 18' is sufficient to inhibit or substantially prevent the inadvertent depression of the actuation button 36 when the page-turning element is pressed against a page or sheet to be turned. Thus, the spring 48 effectively increases the force necessary to depress or actuate the actuation button 36, but not excessively, so that the writing tip actuation mechanism may still be actuated without an undue amount of force being needed.

As shown in FIG. 5, when the actuation button 36 is extended (corresponding to the retracted position of the writing tip), the spring 48 forces the sleeve 38 to its distal limit of travel, as defined by the engagement between the finger 40 of the sleeve 38 and the abutment 44 at the distal end of the slot 42. When sufficient force is applied to the exterior of the page-turning element 18' (as indicated by the arrow in FIG. 6) to overcome the biasing force applied by the spring 48, the sleeve 38 is urged proximally, as shown in solid outline in FIG. 6, and the spring 48 is compressed, allowing the actuation button 36 to be depressed, thereby actuating the writing tip actuation mechanism to extend the writing tip. When pressure is released from the page-turning element 18', the spring 48 returns to its original position (see FIG. 5), thereby carrying the sleeve 38 and the page-turning element 18' back to their original positions, as shown in dotted outline in FIG. 6.

The present invention, as described above, offers the good page-gripping qualities of the conventional rubber finger guard, while also providing the convenience of having a page-turning element attached to proximal end of the writing implement itself. Moreover, the nature of the material from which the page-turning element is made and the textured surface provide good page-gripping characteristics without the need for moistening the device, and without problems such as page abrasion, smudging, or smearing. Furthermore, the shape and configuration of the page-turning element, with a maximum outside diameter that is not substantially greater (as defined above) than that of the implement barrel, allows the writing implement to lie substantially flat and does not interfere with the operation of an extension and retraction mechanism actuation button located in the tip of the second end of the implement's barrel. Finally, permanently fixing the page-turning element to the second end of the writing implement's barrel maximizes ease of use, attractiveness, and durability.

While a preferred embodiment and an alternative embodiment of the invention have been described above, it will be appreciated that a number of variations and modifications may suggest themselves to those skilled in the art. For example, the page-turning element may be made in a wide variety of shapes and sizes (and even colors and patterns) to fit on writing implements of diverse sizes and configurations, or to suit a wide variety of stylistic tastes. The protuberances 19 on the exterior surface of the page-turning element may be made in a geometric and/or color pattern to enhance the aesthetic qualities of the writing implement. These and other variations and modifications that may suggest themselves should be considered within the spirit and scope of the present invention, as defined in the claims that follow.

What is claimed is:

1. A writing implement, comprising:

a barrel having a first end and a second end;

a writing tip movable between a retracted position within the first end of the barrel and an extended position extending from the first end of the barrel, the tip being selectively movable between the retracted position and the extended position by an actuation button extending from the second end of the barrel; and a page-turning element attached to the second end of the barrel so as to overly the actuation button and biased by a biasing force away from the actuation button, whereby the actuation button is actuatable through the page-turning implement by external pressure applied to the page-turning element against the biasing force;

wherein the biasing force is applied by a spring engaged between the second end of the barrel and an interior surface of the page-turning implement.

2. The writing implement of claim 1, wherein the spring is a coil spring coaxially surrounding the actuation button and engageable with the interior of the page-turning element.

3. The writing implement of claim 1, wherein the page-turning element is fixed to a sleeve that fits coaxially around the barrel near the second end thereof and that is axially slidable toward the first end of the barrel when the external pressure is applied to the page-turning element, and toward the second end of the barrel when the external pressure is released from the page-turning element.

4. The writing implement of claim 1, wherein the barrel has a first maximum diameter, and wherein the page-turning element has a second maximum diameter that is not more than about 50% greater than the first maximum diameter.

5. The writing implement of claim 4, wherein the second maximum diameter is not more than about 25% greater than the first maximum diameter.

6. The writing implement of claim 1, wherein the page-turning element is made of a soft, deformable, substantially non-abradable, substantially non-abrasive elastomeric material.

7. The writing implement of claim 6, wherein the material is of A Shore 40 or less.

8. The writing implement of claim 1, wherein the page-turning element has a textured exterior surface.

9. The writing implement of claim 8, wherein the textured exterior surface includes a multiplicity of soft, deformable protuberances.

10. The writing implement of claim 9, wherein the protuberances are about 2 to 3 mm in length, with an average spacing between protuberances of about 2 to 3 mm.

11. A writing implement, comprising:

a barrel having a first end and a second end;

a writing tip movable between a retracted position within the first end of the barrel and an extended position extending from the first end of the barrel, the tip being selectively movable between the retracted position and the extended position by an actuation button extending from the second end of the barrel;

a page-turning element attached to the second end of the barrel so as to overly the actuation button, the page-turning element having an exterior surface formed with a multiplicity of protuberances made of a soft, deformable, substantially non-abradable, substantially non-abrasive elastomeric material; and a biasing element that biases the page-turning element away from the actuation button, whereby the actuation button is actuatable through the page-turning implement by external pressure applied to the page-turning element against the bias of the biasing element.

12. The writing implement of claim 11, wherein the biasing element includes a spring engaged between the second end of the barrel and an interior surface of the page-turning implement.

13. The writing implement of claim 12, wherein the spring is a coil spring coaxially surrounding the actuation button and engageable with the interior of the page-turning element.

14. The writing implement of claim 11, wherein the page-turning element is fixed to a sleeve that fits coaxially around the barrel near the second end thereof and that is axially slidable toward the first end of the barrel when the external pressure is applied to the page-turning element, and toward the second end of the barrel when the external pressure is released from the page-turning element.

15. The writing implement of claim 11, wherein the barrel has a first maximum diameter, and wherein the page-turning element has a second maximum diameter that is not more than about 50% greater than the first maximum diameter.

16. The writing implement of claim 15, wherein the second maximum diameter is not more than about 25% greater than the first maximum diameter.

17. The writing implement of claim 11, wherein the material is of A Shore 40 or less.

18. The writing implement of claim 11, wherein the protuberances are about 2 to 3 mm in length, with an average spacing between protuberances of about 2 to 3 mm.

19. A writing implement, comprising:

a barrel having a first end and a second end;

a writing tip movable between a retracted position within the first end of the barrel and an extended position extending from the first end of the barrel, the tip being selectively movable between the retracted position and the extended position by an actuation button extending from the second end of the barrel; and a page-turning element attached to the second end of the barrel so as to overly the actuation button and biased by a biasing force away from the actuation button, whereby the actuation button is actuatable through the page-turning implement by external pressure applied to the page- turning element against the biasing force;

wherein the page-turning element is fixed to a sleeve that fits coaxially around the barrel near the second end thereof and that is axially slidable toward the first end of the barrel when the external pressure is applied to the page-turning element, and toward the second end of the barrel when the external pressure is released from the page-turning element.

20. The writing implement of claim 19, wherein the biasing force is applied by a spring engaged between the second end of the barrel and an interior surface of the page-turning implement.

21. The writing implement of claim 20, wherein the spring is a coil spring coaxially surrounding the actuation button and engageable with the interior of the page-turning element.

22. The writing implement of claim 19, wherein the barrel has a first maximum diameter, and wherein the page-turning element has a second maximum diameter that is not more than about 50% greater than the first maximum diameter.

23. The writing implement of claim 22, wherein the second maximum diameter is not more than about 25% greater than the first maximum diameter.

24. The writing implement of claim 19, wherein the page-turning element is made of a soft, deformable, substantially non-abradable, substantially non-abrasive elastomeric material.

25. The writing implement of claim 24, wherein the material is of A Shore 40 or less.

26. The writing implement of claim 19, wherein the page-turning element has a textured exterior surface.

27. The writing implement of claim 26, wherein the textured exterior surface includes a multiplicity of soft, deformable protuberances.

28. The writing implement of claim 27, wherein the protuberances are about 2 to 3 mm in length, with an average spacing between protuberances of about 2 to 3 mm.

* * * * *